US005394585A

United States Patent [19]

Connelly

[11] Patent Number: 5,394,585

[45] Date of Patent: Mar. 7, 1995

[54] CARPET WHEEL FOR A ROTARY CLEANING APPARATUS

[76] Inventor: Walter Connelly, 2 Cross St., Pequannock, N.J. 07440

[21] Appl. No.: 238,914

[22] Filed: May 6, 1994

[51] Int. Cl.[6] ..... A47L 11/00; A47L 11/34

[52] U.S. Cl. ..... 15/246; 15/1; 15/3; 15/92; 15/98; 15/385

[58] Field of Search ..... 15/1, 3, 5, 50.1, 91, 15/92, 98, 246, 257.01, 385, 386

[56] References Cited

U.S. PATENT DOCUMENTS 2,645,799 7/1953 Conway ..... 15/92
3,803,666 4/1974 Sawyer ..... 15/92

*Primary Examiner*—Edward L. Roberts
*Attorney, Agent, or Firm*—Michael I. Kroll

[57] ABSTRACT

A carpet wheel is provided for a rotary cleaning apparatus of the type having an electric motor in a housing, a brush member attached to a drive shaft of the motor, a holding tank for a liquid cleaning fluid and a handle extending at an angle upwardly from the holding tank. The carpet wheel comprises a circular shaped base member. Elements are on the base member in a pattern, for forming a plurality of radially extending grooves. The groove forming elements can be releasably positioned against the underside of the brush member, to be rotated thereabout. A plurality of balls are also provided. A structure is for rotatively carrying the balls in the base member, in spaced apart radially extending locations under every other groove, so that the balls will contact and roll upon a carpet. Components are in the base member in every other groove between the grooves with the balls, for allowing the liquid cleaning fluid coming down from the brush member to pass therethrough, to lubricate the balls, so as to evenly apply the liquid cleaning fluid into the carpet to be cleaned.

10 Claims, 2 Drawing Sheets

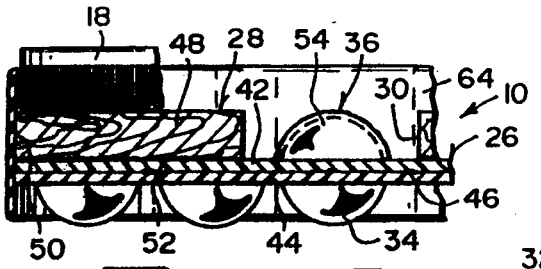
Fig. 3
Fig. 4
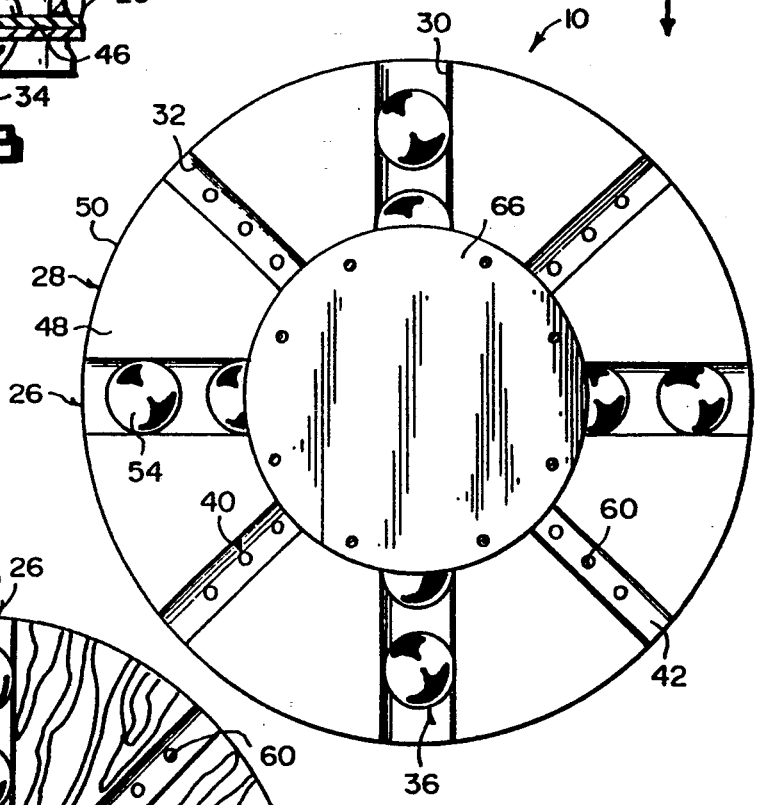
Fig. 5
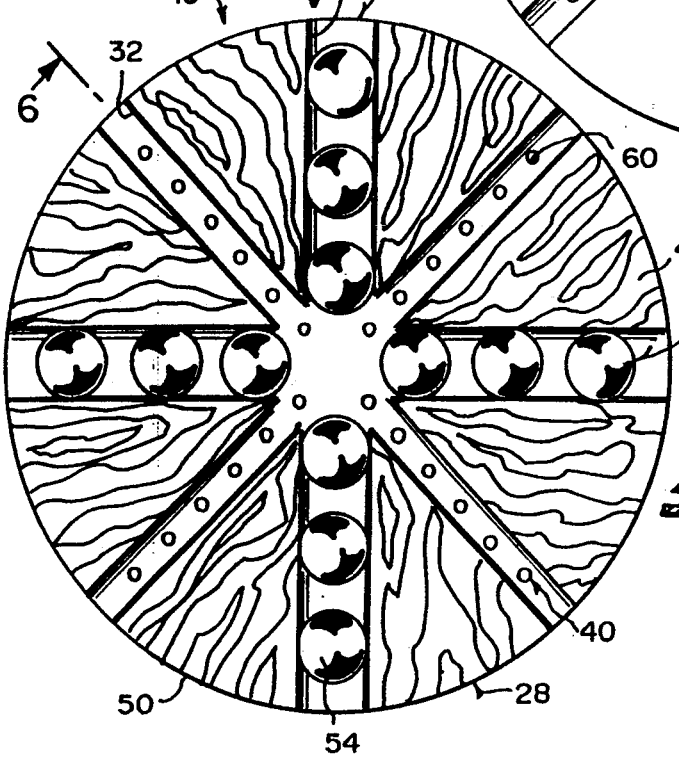
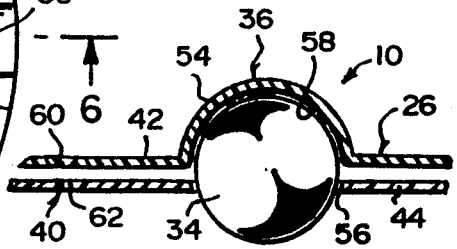
Fig. 6

CARPET WHEEL FOR A ROTARY CLEANING APPARATUS

BACKGROUND OF THE INVENTION

1. Field of the Invention

The instant invention relates generally to cleaning equipment and more specifically it relates to a carpet wheel for a rotary cleaning apparatus.

2. Description of the Prior Art

Numerous cleaning equipment have been provided in prior art. For example U.S. patents numbered Smyth U.S. Pat. No. 3,583,818 et al.; Knestele U.S. Pat. No. 4,884,310; to Kresse U.S. Pat. No. 4,961,242 et al.; Brofsky U.S. Pat. No. 4,998,314 and Koester U.S. Pat. No. 5,142,727 all are illustrative of such prior art. While these units may be suitable for the particular purpose to which they address, they would not be as suitable for the purposes of the present invention as heretofore described.

U.S. Pat. No. 3,583,818 is a carpet shampoo apparatus comprising members both capable of brushing and absorbing. The members move at an angle to the direction of travel to brush and shampoo the carpet, so as to remove excess shampoo liquid and foam from the carpet.

U.S. Pat. No. 4,884,310 is a foam generator constituting or forming part of a carpet-cleaning apparatus has a foam body. A pressing element alternately compresses and permits relaxation of the foam body to generate the foam. A cleaning liquid is supplied to the foam body from the interior of the device. The foam is driven through apertures into the carpet therebelow.

U.S. Pat. No. 4,961,242 is an applicator or absorption cover for the head of a wet floor mop includes a textile support with holder insert pockets sewn on the upper side at opposite longitudinal ends. A sponge cloth or non-women cloth material with high liquid take up capacity is arranged as the underside material in the form of several strips in juxtaposed rows. Each of the strips is attached over the area on the support, to take up dirt and liquids.

U.S. Pat. No. 4,998,314 is a combination of a bonnet and a base member used in connection with a rotary cleaning machine. The combination includes a base member for attachment to a drive shaft of a rotary cleaning machine. A brush member is releasably positioned on the base member. The combination further includes a bonnet constructed of flexible material which includes an opening correspondingly sized and located to receive the brush member therethrough. The bonnet is positioned on the base member such that the brush member extends through the bonnet opening, to form a cleaning surface by the combination of the brush member and bonnet. This arrangement allows the brush member and bonnet to be independently replaceable.

U.S. Pat. No. 5,142,727 is a circular carpet scrubbing bonnet having an upper face and a lower face. Each of the bonnet faces is provided, with a plurality of carpet cleaning solution absorbent areas which are spaced apart laterally by a plurality of carpet scrubbing fibers disposed in parallel, spaced apart positions.

SUMMARY OF THE INVENTION

A primary object of the present invention is to provide a carpet wheel for a rotary cleaning apparatus that will overcome the shortcomings of the prior art devices.

Another object is to provide a carpet wheel for a rotary cleaning apparatus that utilizes the free rolling action of balls incorporated therein, in combination with the natural lubricant of shampoo, to produce a smooth rotating agitation, making it safe for cleaning all types of delicate carpet.

An additional object is to provide a carpet wheel for a rotary cleaning apparatus, in which the wheel rotating in place will eliminate uncontrollable movement of the apparatus, which is normally caused by brush to carpet contact, allowing a lesser skilled person to operate the apparatus safely.

A further object is to provide a carpet wheel for a rotary cleaning apparatus that is simple and easy to use.

A still further object is to provide a carpet wheel for a rotary cleaning apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a cross sectional view of a portion thereof taken along line 3—3 in FIG. 2.

FIG. 4 is a top view of the instant invention per se with the boot removed and an adapter mounting plate attached thereto taken in the direction of arrow 4 in FIG. 2.

FIG. 5 is a top view similar to FIG. 4, with a mounting plate removed therefrom.

FIG. 6 is a cross sectional view taken along line 6—6 in FIG. 5 of a portion of the base member with the lower disc shaped plate exploded therefrom.

DETAILED DESCRIPTION OF THE PREFERRED EMBODIMENTS

Figure 1:
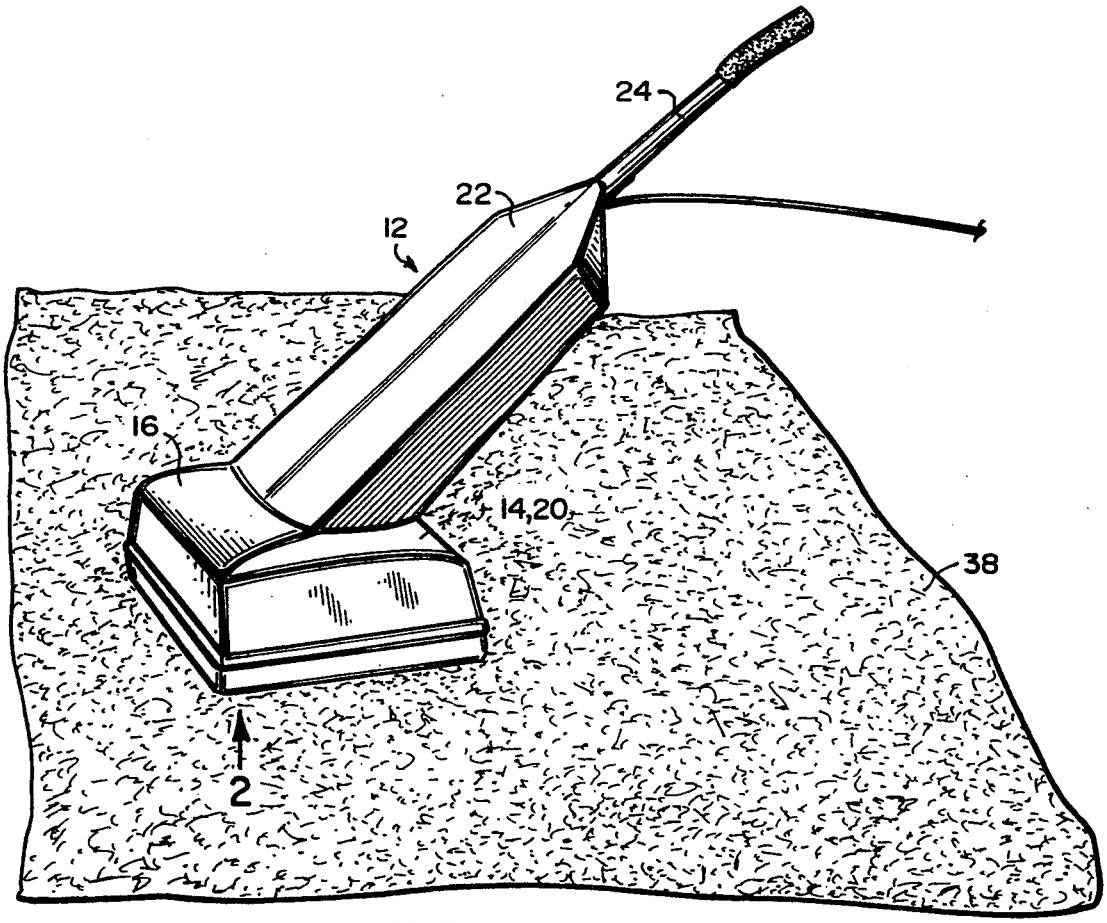
FIG. 1 is a perspective view of a rotary cleaning apparatus on a carpet used in connection with the instant invention.

Turning now descriptively to the drawings, in which similar reference characters denote similar elements throughout the several views, FIGS. 1 through 6 illustrate a carpet wheel 10 for a rotary cleaning apparatus 12 of the type having an electric motor 14 in a housing 16, a brush member 18 attached to a drive shaft 20 of the motor 14, a holding tank 22 for a liquid cleaning fluid and a handle 24 extending at an angle upwardly from the holding tank 22. The carpet wheel comprises a circular shaped base member 26. Elements 28 are on the base member 26 in a pattern, for forming a plurality of radially extending grooves 30, 32. The groove forming elements 28 can be releasably positioned against the underside of the brush member 18, to be rotated thereabout. A plurality of balls 34 are also provided. A structure 36 is for rotatively carrying the balls 34 in the base member 26, in spaced apart radially extending locations under every other groove 30, so that the balls 34 will contact and roll upon a carpet 38. Components 40 are in the base member 26 in every other groove 32 between the grooves 30 with the balls 34, for allowing the liquid cleaning fluid coming down from the brush member 18 to pass therethrough, to lubricate the balls 34, so as to evenly apply the liquid cleaning fluid into the carpet 38 to be cleaned.

The base member 26 includes an upper disc plate 42, a lower disc plate 44 and articles 46 are for fastening the upper disc plate 42 to the lower disc plate 44. The groove forming elements are a plurality of wedge shaped pieces 48. Each wedge shaped piece 48 has a curved outer edge 50, to match up with a portion of the circumference of the upper disc plate 42 and the lower disc plate 44, so as to properly fit thereon. Each wedge shaped piece 48 is secured onto the upper disc plate 42 with adhesive material 52.

The rotatively carrying structure 36 consists of the upper disc plate 42 having a plurality of inverted hemispherical hollow cups 54 in the spaced apart radially extending locations in every other groove 30. The cups 54 are slightly larger in diameter than the balls 34, so that the balls 34 can rotate within the cups 54. The lower disc plate 44 has a plurality of apertures 56 under each cup 54. The apertures 56 are slightly smaller in diameter than the cups 54, so that the balls 34 will be rotatively held in position between the cups 54 and the apertures 56.

Each cup 54 contains an inner thin coating of polytetrafluoroethylene 58, which is a waxy, opaque thermoplastic resin to prevent sticking of the ball 34. The lubricating components 40 consists of the upper disc plate 42 having a plurality of countersunk drip holes 60 in the spaced apart radially extending locations in every other groove 32 between the grooves 30 with the balls 34. The lower disc plate 44 has a plurality of drip holes 62, to match up with the countersunk drip holes 60 in the upper disc plate 42, so that the liquid cleaning fluid can pass therethrough.

Figure 2:
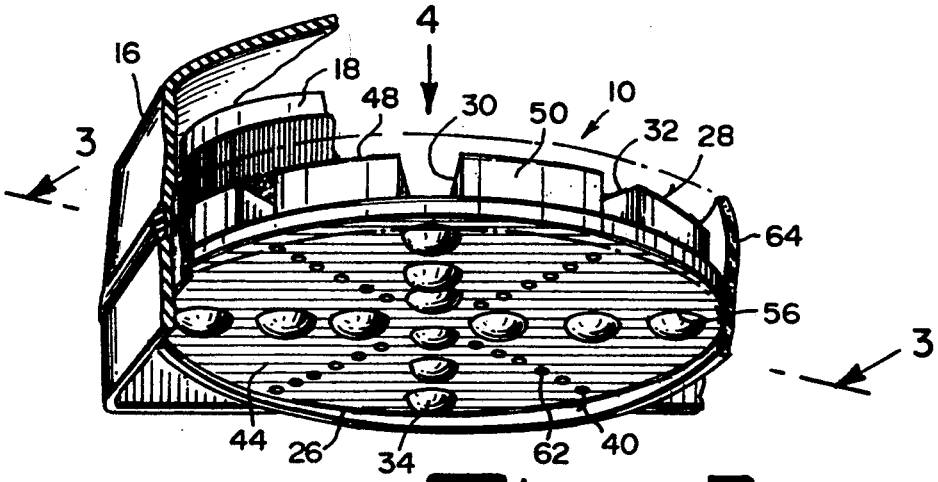
FIG. 2 is a bottom perspective view with parts broken away taken in the direction of arrow 2 in FIG. 1.

A rubber boot 64, as shown in FIGS. 2 and 3, can extend about the perimeter thereof, to prevent the liquid cleaning fluid from spinning off, when releasably positioned against the underside of the brush member 18.

A mounting adapter plate 66, as shown in FIG. 4, can be centrally secured onto the wedge shaped pieces 48, in which a hub (not shown) can be affixed onto the mounting adapter plate 66, so that when the brush member 18 is removed, direct connection via the hub can be made with the drive shaft 20 of the motor 14 in the rotary cleaning apparatus 12.

LIST OF REFERENCE NUMBERS

10 carpet wheel
12 rotary cleaning apparatus
14 electric motor
16 housing
18 brush member
20 drive shaft of 14
22 holding tank
24 handle
26 circular shaped base member
28 groove forming elements
30 radially extending groove
32 radially extending groove
34 ball
36 rotatively carrying structure
38 carpet
40 lubricating component
42 upper disc plate of 26
44 lower disc plate of 26
46 fastening article
48 wedge shaped piece
50 curved outer edge of 48
52 adhesive material
54 inverted hemispherical hollow cup on 42
56 aperture in 44
58 coating in 54
60 countersunk drip hole in 42
62 drip hole in 44
64 rubber boot
66 mounting adapter plate It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A carpet wheel for a rotary cleaning apparatus of the type having an electric motor in a housing, a brush member attached to a drive shaft of the motor, a holding tank for a liquid cleaning fluid and a handle extending at an angle upwardly from the holding tank, the carpet wheel comprising:

a) a circular shaped base member;
b) means on said base member in a pattern, for forming a plurality of radially extending grooves, whereby said groove forming means can be releasably positioned against the underside of the brush member to be rotated thereabout;
c) a plurality of balls;
d) means for rotatively carrying said balls in said base member in spaced apart radially extending locations under every other groove, so that said balls will contact and roll upon a carpet; and
e) means in said base member in every other groove between the grooves with said balls, for allowing the liquid cleaning fluid coming down from the brush member to pass therethrough, to lubricate said balls, so as to evenly apply the liquid cleaning fluid into the carpet to be cleaned.

2. A carpet wheel for a rotary cleaning apparatus as recited in claim 1, wherein said base member includes:

a) an upper disc plate;
b) a lower disc plate; and
c) means for fastening said upper disc plate to said lower disc plate.

3. A carpet wheel for a rotary cleaning apparatus as recited in claim 2, wherein said groove forming means includes a plurality of wedge shaped pieces.

4. A carpet wheel for a rotary cleaning apparatus as recited in claim 3, wherein each said wedge shaped piece includes a curved outer edge to match up with a portion of the circumference of said upper disc plate and said lower disc plate, so as to properly fit thereon.

5. A carpet wheel for a rotary cleaning apparatus as recited in claim 4, wherein each said wedge shaped piece is secured onto said upper disc plate with adhesive material.

6. A carpet wheel for a rotary cleaning apparatus as recited in claim 5, wherein said rotatively carrying means includes:

a) said upper disc plate having a plurality of inverted hemispherical hollow cups in the spaced apart radially extending locations in every other groove, said cups being slightly larger in diameter than said balls, so that said balls can rotate within said cups; and b) said lower disc plate having a plurality of apertures under each said cup, said apertures being slightly smaller in diameter than said cups, so that said balls will be rotatively held in position between said cups and said apertures.

7. A carpet wheel for a rotary cleaning apparatus as recited in claim 6, wherein each said cup includes an inner thin coating of polytetrafluoroethylene, which is a waxy, opaque thermoplastic resin to prevent sticking of said ball.

8. A carpet wheel for a rotary cleaning apparatus as recited in claim 7, wherein said lubricating means includes:

a) said upper disc plate having a plurality of countersunk drip holes in the spaced apart radially extending locations in every other groove between the grooves with said balls; and b) said lower disc plate having a plurality of drip holes to match up with said countersunk drip holes in said upper disc plate, so that the liquid cleaning fluid can pass therethrough.

9. A carpet wheel for a rotary cleaning apparatus as recited in claim 8, further including a rubber boot to extend about the perimeter thereof, to prevent the liquid cleaning fluid from spinning off, when releasably positioned against the underside of the brush member.

10. A carpet wheel for a rotary cleaning apparatus as recited in claim 8, further including a mounting adapter plate secured centrally onto said wedge shaped pieces, in which a hub can be affixed onto said mounting adapter plate, so that when the brush member is removed direct connection via the hub can be made with the drive shaft of the motor in the rotary cleaning apparatus.

* * * * *